United States Patent [19]

Sugiyama et al.

[11] 4,067,738

[45] Jan. 10, 1978

[54] PHOTOGRAPHIC LIGHT-SENSITIVE ELEMENT HAVING A DYED LAYER

[75] Inventors: Masatoshi Sugiyama; Tadashi Ikeda; Akira Ogawa; Yasuharu Nakamura; Fujio Kakimi, all of Minami-ashigara, Japan

[73] Assignee: Fuji Photo Film Co., Ltd., Minami-ashigara

[21] Appl. No.: 719,536

[22] Filed: Sept. 1, 1976

[30] Foreign Application Priority Data

Sept. 2, 1975 Japan ..... 50-106135

[51] Int. Cl.[2] ..... G03C 1/84

[52] U.S. Cl. ..... 96/84 R; 252/300; 96/73; 542/453; 542/476

[58] Field of Search ..... 96/84 R, 73, 99, 131; 252/300 H; 260/240.1

[56] References Cited

U.S. PATENT DOCUMENTS

| | | | |
|---|---|---|---|
| 3,282,699 | 11/1966 | Jones et al. | 96/84 |
| 3,427,310 | 2/1969 | Gaspar | 96/84 R |

*Primary Examiner*—John D. Welsh

*Attorney, Agent, or Firm*—Sughrue, Rothwell, Mion, Zinn and Macpeak

[57] ABSTRACT

A silver halide photographic light-sensitive element containing at least one dye represented by general formula (I) set forth below in at least one hydrophilic colloid layer of the silver halide photographic light-sensitive element:

(I)

wherein X represents an amino group, a hydroxy group or an alkoxy group; *m* represents 0 or 1; Q represents an aryl group substituted with at least one of a sulfo group, a sulfoalkyl group or a carboxy group; $R^1$ represents an aliphatic group; $R^2$ and $R^3$, which may be the same or different, each represents a hydrogen atom, an alkyl group, an alkoxycarbonyl group, an acyl group or a carboxy group; $L^1$, $L^2$, $L^3$ and $L_4$ each represents a methine group, an alkyl substituted methine group or a phenyl substituted methine group; and *n* represents 0 or 1.

16 Claims, No Drawings

PHOTOGRAPHIC LIGHT-SENSITIVE ELEMENT HAVING A DYED LAYER

BACKGROUND OF THE INVENTION

1. FIELD OF THE INVENTION

The present invention relates to a silver halide photographic light-sensitive element having a dyed hydrophilic colloid layer.

2. DESCRIPTION OF THE PRIOR ART

In a silver halide photographic light-sensitive element, a photographic emulsion layer or another hydrophilic colloid layer is often dyed for the purpose of absorbing light having a specific wavelength range.

When the spectral composition of the light introduced into a photographic emulsion layer must be controlled, a dyed layer is usually provided at a position farther away from the support than the photographic emulsion layer. Such a dyed layer is designated a filter layer. In the case of a multilayer color light-sensitive element having a plurality of photographic emulsion layers, the filter layer layer can be positioned between photographic emulsion layers.

In order to prevent image blurring, namely, halation caused by the fact that light scattered on passing through the photographic emulsion layer or after transmission is reflected at an interface between the emulsion layer and the support or a surface of the light-sensitive element opposite the emulsion layer and is introduced again into the photographic emulsion layer, a dyed layer is usually provided between the photographic emulsion layer and the support or on the surface of the support opposite the photographic emulsion layer. Such a dyed layer is designated an antihalation layer. In the case of a plurality of photographic emulsion layers such as exists in a multilayer color light-sensitive element, the antihalation layer can be positioned between photographic emulsion layers.

In order to prevent a deterioration of the sharpness of images due to scattering of light in a photographic emulsion layer (this phenomenon is called irradiation), the photographic emulsion layer can also be dyed.

Generally, a water soluble dye is added to the hydrophilic colloid layer to be dyed. The dye used for such a purpose should not only have an appropriate spectral absorption according to the purpose of use but also the following properties.

1. The dye should be photographically chemically inactive. Namely, the dye should not have an adverse chemical influence upon the properties of the silver halide photographic emulsion layers, for example, reduction of sensitivity, deterioration of latent images or fog, etc.
2. The dye should be decolored during photographic processings or the dye should dissolve in the processing solutions or water used for rinsing and should not result in a coloration of the photographic light-sensitive element after processing.

In order to discover dyes which satisfy these requirements, much effort has been expended by persons skilled in the art. For example, oxonol dyes having a pyrazolone nucleus represented by the dyes described in British Pat. No. 506,385, oxonol dyes having a barbituric acid nucleus represented by the dyes described in U.S. Pat. No. 3,247,127, oxonol dyes described in U.S. Pat. Nos. 2,533,472 and 3,379,533 and British Pat. No. 1,278,621, hemioxonol dyes represented by the dyes described in British Pat. No. 584,609, styryl dyes represented by the dyes described in U.S. Pat. No. 2,298,733, merocyanine dyes represented by the dyes described in U.S. Pat. No. 2,493,747 and cyanine dyes represented by the dyes described in U.S. Pat. No. 2,843,486 are known.

Many of the dyes which are decolored during processing of the photographic emulsion can be decolored by sulfites (or bisulfites) included in processing solutions or by sulfites under alkaline conditions, for example, as described in British Pat. No. 506,385.

Where the dyed layer is a filter layer or where the dyed layer is an antihalation layer positioned on the support and on the same side of the support as the photographic emulsion layer(s), such a layer often must be selectively dyed while other layers should not substantially be affected. If such a requirement is not satisfied, the dye not only produces a harmful spectral effect upon other layers but also the dye deteriorates effects as a filter layer or as an antihalation layer.

In order to selectively dye a specified hydrophilic colloid layer, many processes are known. However, a process which comprises incorporating a hydrophilic polymer having a charge of the opposite polarity to a dye ion as a mordanting agent in the hydrophilic colloid layer, whereby the dye is present in the specified layer due to a mutual interaction between the dye molecule and the hydrophilic polymer, is most commonly used (it is believed that not only an attraction due to the charges but also a hydrophobic bond contributes thereto).

As the mordanting agent, there can be exemplified polymers derived from ethylenically unsaturated compounds having a dialkylaminoalkyl ester group as described in British Pat. No. 685,475, reaction products prepared by reacting a polyvinylalkylketone with aminoguanidine as described in British Pat. No. 850,281 and polymers derived from 2-methyl-1-vinyl-imidazole as described in U.S. Pat. No. 3,445,231. Where a process involving mordanting by such polymers is used, if the layer containing the dye is contacted with another hydrophilic colloid layer in the wet state, a portion of the dye often diffuses from the dye layer to the other colloid layer. Such a diffusion of the dye depends not only on the chemical structure of the mordanting agent but also on the chemical structure of the dye used.

Where the above described high molecular weight mordanting agent is used, residual color in the light-sensitive element easily results after photographic processings and particularly after photographic processings where the processing time is shortened. The reason therefor is believed to be that the dye or a reversible decolored product remains in the layer containing the mordanting agent because some bonding strength of the dye to the mordanting agent remains, even though the bonding strength becomes considerably weakened in alkaline solutions such as a developer solution. Although such difficulty depends on the chemical structure of the mordanting agent to a great extent, it also depends on the chemical structure of the dye.

Of the various water soluble dyes used for dyeing the hydrophilic colloid layer of a photographic light-sensitive element, merocyanine dyes having a benzoxazole nucleus as described in U.S. Pat. Nos. 3,148,187 and 3,282,699 have been preferred because they are irreversibly decolored in a developer solution containing sulfites and hardly have any adverse influence on the photographic properties of the photographic emulsion. However, the above described merocyanine dyes are sufficiently mordanted only by a specific basic polymer and often diffuse from the layer containing a basic polymer to other layers, even though acid groups such as sulfo groups are introduced into both terminals of their molecules.

SUMMARY OF THE INVENTION

One object of the present invention is to provide a photographic light-sensitive element having a hydrophilic colloid layer which contains a water soluble dye which can be irreversibly decolored during photographic processings and which does not adversely influence the photographic properties of the photographic emulsion.

Another object of the present invention is to provide a silver halide photographic light-sensitive element wherein only a hydrophilic colloid layer containing a basic polymer is sufficiently and selectively dyed.

A further object of the present invention is to provide a photographic light-sensitive element which comprises a hydrophilic colloid layer containing a dye which does not result in residual color after photographic processings, even though a basic polymer is included in any of the hydrophilic colloid layers.

These objects of the present invention are attained with a silver halide photographic light-sensitive element wherein at least one hydrophilic colloid layer contains a basic polymer and at least one hydrophilic colloid layer contains at least one dye represented by the following general formula (I):

(I)

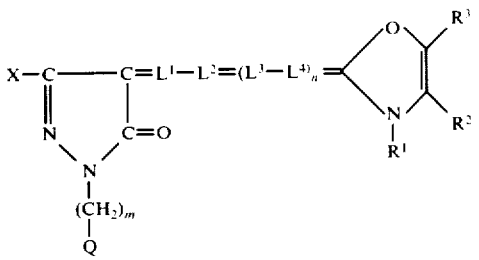

wherein X represents an amino group, which includes an unsubstituted amino group and a substituted amino group, for example, a monoalkyl substituted amino group having 1 to 6 carbon atoms (such as an ethylamino group, a butylamino group, etc.), a dialkyl substituted amino group having 1 to 8 carbon atoms, where ther carbon atom range applies to the total number of carbon atoms in both alkyl groups, (such as an N,N-diisopropylamino group, an N,N-di-n-butylamino group, etc.), an amino group substituted with an acyl group containing an aliphatic hydrocarbon group having 1 to 8 carbon atoms or an aromatic hydrocarbon group (such as an acetylamino group, a propionylamino group, a β-sulfopropionylamino group, a benzoylamino group, a 2'-sulfobenzoylamino group, etc.), an aryl substituted amino group having 6 to 8 carbon atoms (where the aryl group can be substituted with groups such as, e.g., halogen, sulfo, alkyl, etc., such as an anilino group, a p-chloroanilino group, a p-sulfoanilino group, a p-toluidino group, etc.); a cyclic amino group (most preferably having a 5- or 6-membered ring, such as a pyridino group, a morpholino group, a piperidino group, a piperazino group, etc.); an unsubstituted ureido group; a substituted ureido group, for example, a ureido group substituted with a substituent such as an alkyl group having 1 to 8 carbon atoms (such as a methyl group, an ethyl group, an isopropyl group, an n-hexyl group, etc.) or an aryl such as phenyl group, a substituted alkyl group having 1 to 8 carbon atoms in the alkyl moiety with a substituent such as a halogen atom, an alkoxycarbonyl group, an alkoxy group or an aryloxy group, etc., (such as a chloromethyl group, a β-chloroethyl group, a γ-chloropropyl group, an ethoxycarbonylmethyl group, a β-ethoxyethyl group, an α-ethoxyethyl group, a β-butoxyethyl group, an α-phenoxyethyl group, a 2-chloro-2-methylpropyl group, an n-perfluorobutyl group, etc.), an alicyclic hydrocarbon group having 5 or 6 carbon atoms (such as a cyclopentyl group, a cyclopexyl group, etc.), a monocyclic aryl group which may be substituted with, e.g., a halogen atom, a nitro group, an alkoxy group, an alkoxycarbonyl group, an amino group or a dialkylamino group (such as a phenyl group, a tolyl group, a 4-chlorophenyl group, a 4-nitrophenyl group, a 4-methoxyphenyl group, a 4-ethoxycarbonylphenyl group, a 4-dimethylaminophenyl group, etc.), an aralkyl group having 7 to 10 carbon atoms (such as a benzyl group, a phenethyl group, an α-methylbenzyl group, etc.), an alkenyl group having 2 to 4 carbon atoms (such as an allyl group, etc.), an acyl group (for example, an alkylcarbonyl group having 2 to 8 carbon atoms (such as an acetyl group, a propionyl group, etc.), an aromatic carboxylic acyl group (preferably a monoaryl monocarboxylic acid, for example, such as a benzoyl group, etc.), an alkylsulfonyl group having 1 to 6 carbon atoms, even more preferably 1 to 3 carbon atoms, (such as a methanesulfonyl group, a propanesulfonyl group, etc.), or an arylsulfonyl group (such as a benzenesulfonyl group, a toluenesulfonyl group, etc.), which may be substituted, if desired), a heterocyclic group (such as a 2-thienyl group, etc.), or the like; a hydroxy group; an alkoxy group having 1 to 8 carbon atoms which includes an unsubstituted alkoxy group (such as a methoxy group, an ethoxy group, a propoxy group, an isopropoxy group, a butoxy group, etc.) and a substituted alkoxy group with a substituent such as a halogen atom, an alkoxy group having 1 to 3 carbon atoms or the like (for example, a β-chloroethoxy group, a β-methoxyethoxy group, etc.), and the like.

Q represents an aryl group substituted with at least one of a sulfo group, a sulfoalkyl group (where the alkyl moiety preferably has 1 to 4 carbon atoms) or a carboxy group (such as a 4-sulfophenyl group, a 4-(sulfomethyl)-phenyl group, a 4-(δ-sulfobutyl)phenyl group, a 3-sulfophenyl group, a2,5-disulfophenyl group, a 3,5-disulfophenyl group, a3,5-dicarboxyphenyl group, a 4-carboxyphenyl group, a 6,8-disulfo-2-naphthyl group, a 4,8-disulfo-2-naphtthyl group, etc.). The sulfo group, the sulfoalkyl group and the carboxy group can be in the form of the free acid or salt form together with an alkali metal (such as sodium, potassium, etc.), or an ammonium group. Preferably no more than 3 sulfo groups are present. Further, Q can be substituted with a substituent other than a sulfo group, a sulfozlkyl group and carboxy group, though it is preferred that no more than 3 of such other substituents be present, for example, an alkyl group having 1 to 4 carbon atoms (such as a methyl group, an ethyl group, butyl group, etc.), a halogen atom (such as a chlorine atom, a bromine atom, etc.), an alkoxy group having 1 to 4 carbon atoms (such as a methoxy group, an ethoxy group, etc.), a phenoxy group, and the like.

$R^1$ represents an aliphatic group, for example, an alkyl group having 1 to 8 carbon atoms (such as a methyl group, an ethyl group, an n-butyl group, etc.), such an alkyl group substituted with a halogen atom, a cyano group, a phenyl group, a carboxy group, a sulfoalkoxy group, where the alkoxy moiety preferably has 1 to 4 carbon atoms, or a sulfo group (such as a chloromethyl group, a β-chloroethyl group, a β-bromoethyl group, a β-cyanoethyl group, a p-sulfobenzyl group, a β-carboxyethyl group, a (γ-sulfopropoxy)methyl group, a γ-sulfoethyl group, a γ-sulfopropyl group, a δ-sulfobutyl group, a γ-sulfobutyl group, etc.), and the like.

$R^2$ and $R^3$, which may be the same or different, each represents a hydrogen atom; a carboxy group; an aliphatic carboxylic acyl group, most preferably an acyl group having 1 to 3 carbon atoms in its alkyl moiety and which may be substituted with, for example, an acetyl group, a chloroacetyl group, a cyanoacetyl group, etc.; an alkoxycarbonyl group having 2 to 7 carbon atoms (such as a methoxycarbonyl group, an ethoxycarbonyl group, a butoxycarbonyl group, etc.); or an alkyl group having 1 to 6 carbon atoms (such as a methyl group, an ethyl group, a butyl group, etc.).

*m* represents 0 or 1. $L^1$, $L^2$, $L^3$ and $L^4$ each represents a methine group or a methine group substituted with an alkyl group having 1 to 4 carbon atoms or a phenyl group. *n* represents 0 or 1.

DETAILED DESCRIPTION OF THE INVENTION

In general formula (I), the substituents represented by X are preferably an alkoxy group, a hydroxy group, an amino group or a substituted ureido group. Particularly preferred substituents are a hydroxy group and an alkylureido group. For m, O is preferred. A preferred substituent represented by Q is a phenyl group substituted with at least one sulfo group. Preferred substituents represented by $R^1$ are an alkyl group, a carboxyalkyl group and a sulfoalkyl group. $R^2$ and $R^3$ each preferably represents a hydrogen atom or an alkyl group. $L^1$, $L^2$, $L^3$ and $L^4$ each preferably represents an unsubstituted methine group or only $L^1$ represents a methyl substituted methine group and the balance of $L^2$, $L^3$ and $L^4$ are unsubstituted methine groups.

Specific examples of dyes represented by general formula (I) used in the present invention are shown in the following. However, the present invention is not to be construed as being limited to these examples.

Dye 1

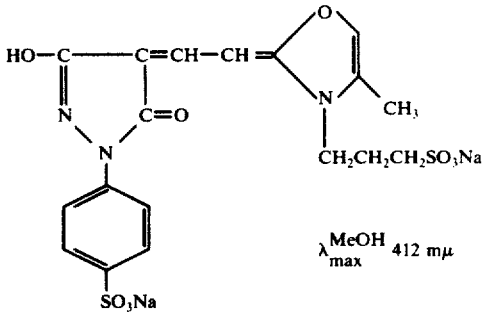

$\lambda_{max}^{MeOH}$ 412 mμ

Dye 2

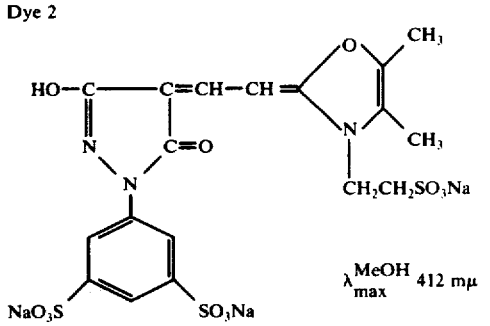

$\lambda_{max}^{MeOH}$ 412 mμ

Dye 3

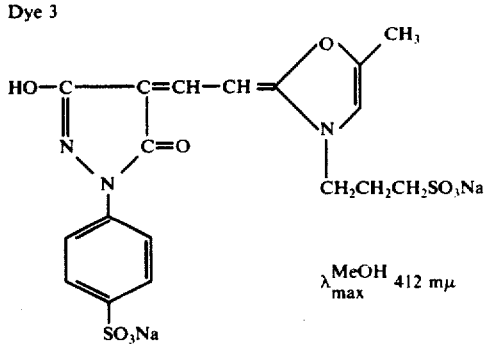

$\lambda_{max}^{MeOH}$ 412 mμ

Dye 4

-continued
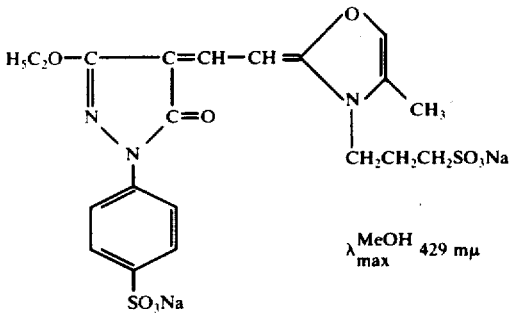
$\lambda_{max}^{MeOH}$ 429 mμ
Dye 5
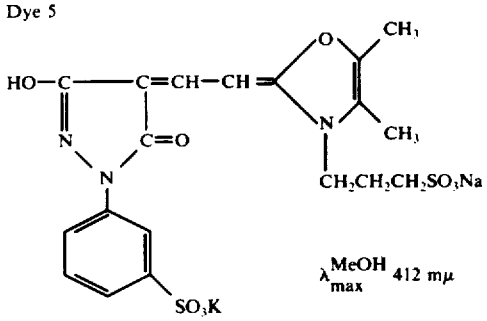
$\lambda_{max}^{MeOH}$ 412 mμ
Dye 6
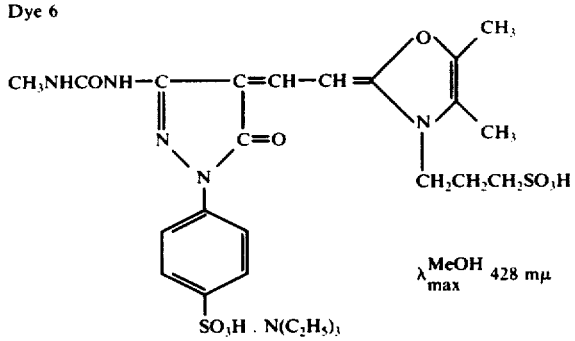
$\lambda_{max}^{MeOH}$ 428 mμ
Dye 7
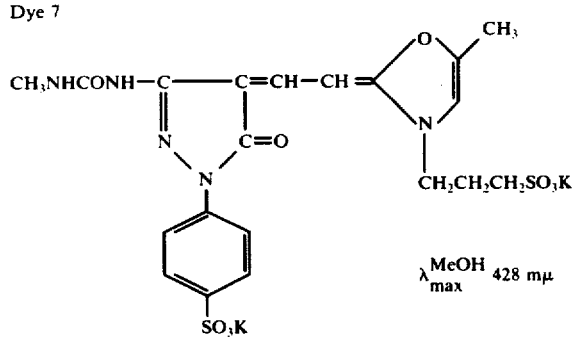
$\lambda_{max}^{MeOH}$ 428 mμ
Dye 8
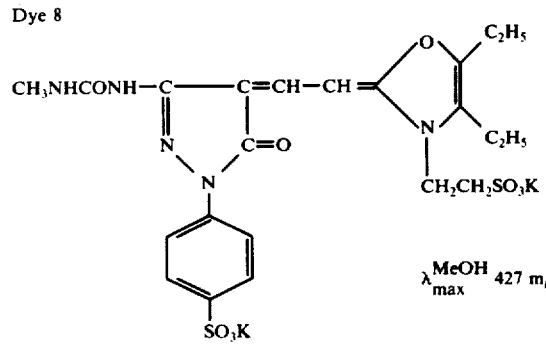
$\lambda_{max}^{MeOH}$ 427 mμ

-continued
Dye 9
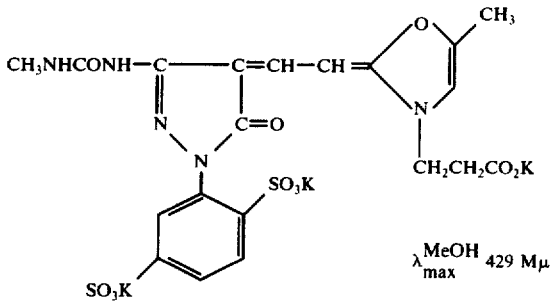
$\lambda_{max}^{MeOH}$ 429 Mμ
Dye 10
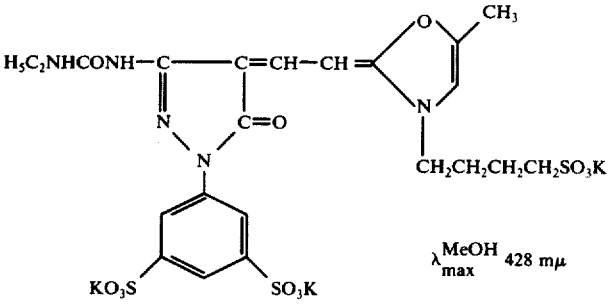
$\lambda_{max}^{MeOH}$ 428 mμ
Dye 11
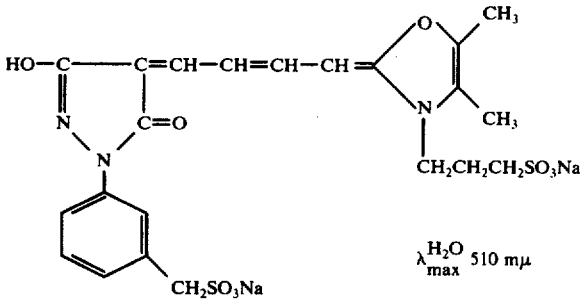
$\lambda_{max}^{H_2O}$ 510 mμ
Dye 12
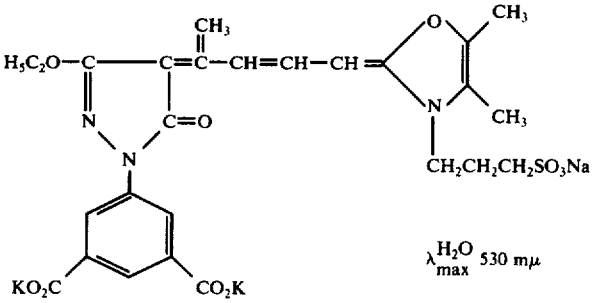
$\lambda_{max}^{H_2O}$ 530 mμ
Dye 13

-continued
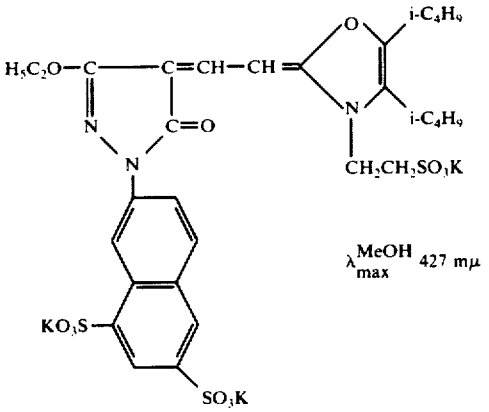
$\lambda_{max}^{MeOH}$ 427 mμ
Dye 14
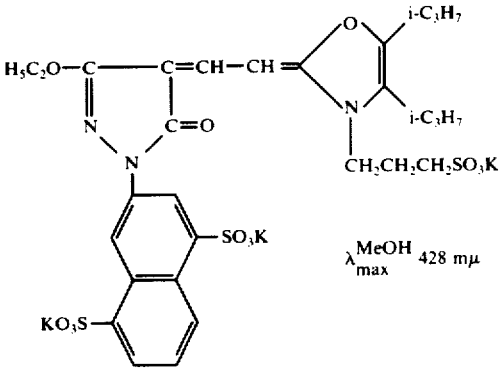
$\lambda_{max}^{MeOH}$ 428 mμ
Dye 15
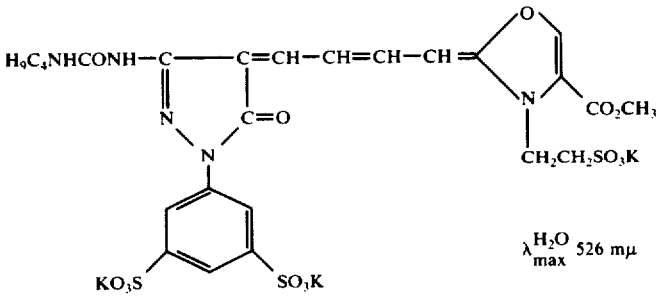
$\lambda_{max}^{H_2O}$ 526 mμ
Dye 16
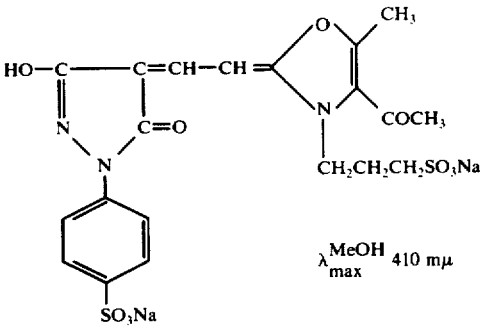
$\lambda_{max}^{MeOH}$ 410 mμ
Dye 17

-continued

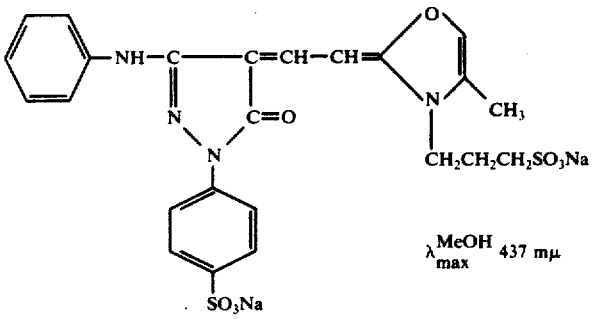

$\lambda_{max}^{MeOH}$ 437 mμ

Dye 18

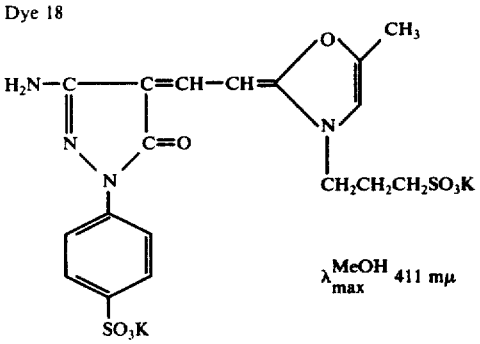

$\lambda_{max}^{MeOH}$ 411 mμ

Dye 19

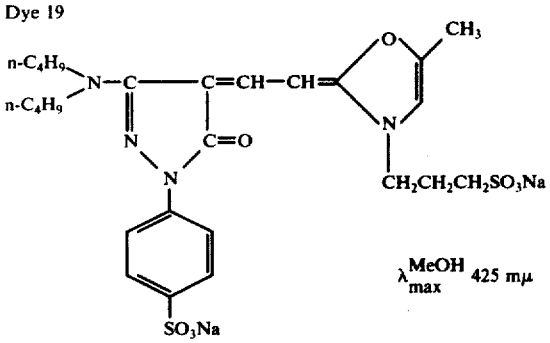

$\lambda_{max}^{MeOH}$ 425 mμ

Dye 20

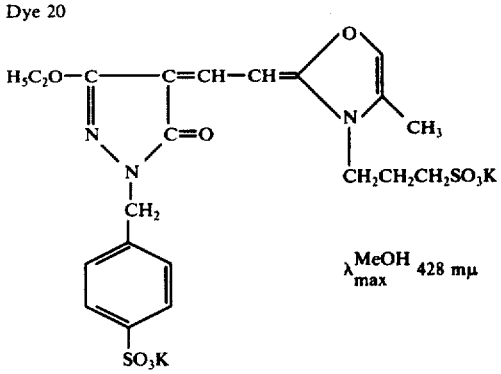

$\lambda_{max}^{MeOH}$ 428 mμ

The merocyanine dyes used in the present invention can be easily synthesized by persons skilled in the art according to processes for preparing known merocyanine dyes, and intermediates therefor can be easily synthesized according to processes for preparing intermediates of known merocyanine dyes. For example, the merocyanine dyes used in the present invention can be easily synthesized by reacting suitable intermediate compounds such as anilinomethylene compounds, acetoanilidomethylene compounds, mercapto compounds or halo compounds with active methylene compounds or active methyl compounds using a suitable basic condensing agent according to the processes described in, for example, Japanese Patent Publication 24696/71, E. D. Synch, Zh. N. Belaya, L. P. Umanskaya, E. D. Smaznaya- I'lina; Ukr. Khim. Zh., 32 (3), 274 (1966); B. Davidson, S. A. Bernhard, J. Am. Chem. Soc., 70, 3426 (1948); U.S. Pat. Nos. 2,493,747, 3,440,052, 3,531,287 and 3,440,051; British Pat. No. 1,265,485; Japanese Pat. Publication 27063/1969; Chem. Ber., 10, 2048; U.S. Pat. No. 3,455,684; British Pat. 1,030,392; and U.S. Pat. Nos. 3,379,533, 3,480,439, 3,411,916, 3,364,026, 3,352,680, 3,251,691, 3,288,610, 3,567,719, 2,743,273, 2,856,404, 2,882,159, and 2,778,822. Specific examples of processes for preparing the dyes are exemplified in the following.

SYNTHESIS EXAMPLE 1

(Synthesis of Dye 1)

30.0 g of anhydro-2-(2-anilinovinyl)-4-methyl-3-(3-sulfopropyl)oxazolium hydroxide and 25.3 g of 3-hydroxy-1-(p-sulfophenyl)-5-pyrazolone sodium salt were added to 250 ml of ethyl alcohol, and 26 ml of acetic anhydride was added thereto with stirring. Further, 64 ml of triethylamine was added dropwise thereto and the mixture was reacted by heating on a steam bath for one hour. After distilling off a half of the volume of ethanol, the reaction solution was filtered. 20 ml of concentrated hydrochloric acid was gradually added to the filtrate and the crystals deposited were collected by filtration. 35.0 g of the crude crystals collected were dissolved in 300 ml of ethyl alcohol and 15 ml of triethylamine by heating and the system then filtered. 200 ml of a methanol solution containing 15 g of sodium acetate was added dropwise to the filrate at room temperature with stirring, and, after 30 minutes, the crystals deposited were collected by filtration to yield 29 g of the dye.

Melting point: above 300° C, $\lambda_{max}^{H_2O}$: 395 mμ

SYNTHESIS EXAMPLE 2

(Synthesis of Dye 4)

32.3 g of anhydro-2-(2-anilinovinyl)-4-methyl-3-(3-sulfopropyl)oxazolium hydroxide and 38.5 g of 3-ethoxy-1-(p-sulfophenyl)-5-pyrazolone triethylamine salt were added to 300 ml of ethanol and 30.0 ml of acetic anhydride was added thereto with stirring. Further, 60.0 ml of triethylamine was added dropwise thereto and the mixture was heated on a steam bath for 20 minutes. After distilling off half of the volume of ethanol, 200 ml of a methanol solution containing 17 g of sodium acetate was added thereto dropwise with stirring and the mixture was stirred for an additional one hour. The crystals deposited where then suspended in 200 ml of ethanol and washed by boiling for 30 minutes to yield 31 g of the dye.

Melting point: above 300° C, $\lambda_{max}^{H_2O}$: 407 mμ

SYNTHESIS EXAMPLE 3

(Synthesis of Dye 17)

20.0 g of anhydro-2-(2-anilinovinyl)-4-methyl-3-(3-sulfopropyl)oxazolium hydroxide and 20.5 g of 3-anilino-1-(p-sulfophenyl)-5-pyrazolone were added to 200 ml of ethanol, and 24.0 ml of acetic anhydride was added thereto with stirring. Further, 51.0 ml of triethylamine was added dropwise thereto and the mixture was heated on a steam bath for 15 minutes. After distilling off half of the volume of ethanol, 100 ml of a methanol solution containing 14.0 g of potassium acetate was added dropwise thereto at room temperature with stirring and after 30 minutes the crystals deposited were collected by filtration. The crystals were added to 200 ml of ethanol and washed by boiling for 30 minutes to yield 23.0 g of the dye.

Melting point: above 300° C, $\lambda_{max}^{H_2O}$: 416 mμ

Other merocyanine dyes represented by formula (I) can easily be synthesized in the same manner as described above using a suitable solvent such as ethanol, isopropanol, acetonitrile, acetonitrile-dimethylformamide, acetic anhydride, acetic acid, dimethylformamide, nitrobenzene, γ-butyrolactone or m-cresol, and, if desired, a suitable basic condensing agent such as triethylamine, piperidine, 1,5-diazabicyclo(5,4,0)undecene-5, morpholine or soium acetate, and the like.

In the photographic light-sensitive elements of the present invention, the dye can be introduced into the hydrophilic colloid layer using any conventional method. For example, an aqueous solution of the dye at a suitable concentration can be added to an aqueous solution of the hydrophilic colloid, and the resulting solution coated using a known method on a support or a layer of the photographic light-sensitive element.

The amount of the dye employed in the aqueous solution of the hydrophilic colloid can be chosen within the solubility range of the dye according to the purpose. In general, an aqueous solution of the hydrophilic colloid to which an aqueous solution of the dye at a concentration of about 0.5 to 3% is added is coated to provide a coverage of 8 to 800 mg of the dye per $m^2$ of the light-sensitive element.

In the light-sensitive element of the present invention, although it is advantageous to add the dye to a coating solution for forming a hydrophilic colloid layer containing a basic polymer, the dye can be added to a coating solution for forming another hydrophilic colloid layer, e.g., a photographic emulsion layer or a coating solution for forming another non-light sensitive layer. In the latter case, it is preferred to introduce the dye into a layer which is near and preferably adjacent the basic polymer containing layer. The dye diffuses into the layer which contains the basic polymer, even if the dye is introduced into a layer which does not contain the basic polymer, and, consequently, the basic polymer containing layer is selectively dyed in the finished light-sensitive element. The dye can be introduced into two or more layers, if desired, in which case the total amount of dye in both layers in from 8 to 800 mg of dyes/$m^2$ of sensitive material.

The hydrophilic colloid layer containing a basic polymer can be a single layer or can comprise two or more layers. This layer (or layers) can be positioned above a photographic emulsion layer (i.e., farther from the support), or can be positioned between photographic emulsion layers if a plurality of photographic emulsion layers is present, or between a photographic emulsion layer and the support. The layer dyed selectively due to the presence of the basic polymer can have the function of a filter layer, an antihalation layer or a layer for another purpose according to its position. The hydrophilic colloid layer most preferably comprises gelatin, which term includes acid processed gelatin, lime processed gelatin and acylated gelatin. Other hydrophilic colloids which can be used to form the hydrophilic colloid layer include, for example, cellulose sulfate, partially hydrolyzed polyvinyl acetate, polyvinyl pyrrolidone, polyacrylamide, and the like.

The photographic light-sensitive element of the present invention contains a basic polymer in at least one hydrophilic colloid layer. The basic polymer is a water soluble high molecular weight material which has basic groups in its main chain or in a branched chain thereof and which is compatible with gelatin. Although the amount of the basic polymer in the hydrophilic colloid layer is not limited, a preferred amount is such that an amount equivalent to about 2 to about 20 basic functional groups is present per mol of the dye present in the hydrophilic colloid layer. It is even more preferred that the amount of basic polymer be selected so that 2 to 15 basic groups are present per acidic group of the dye molecule. However, a smaller amount of basic polymer can be used in combination with certain dyes, for example, dyes having an alkyl ureido or aryl ureido group. Basic hydrophilic high molecular weight materials which are generally used for mordanting acid dyes for the hydrophilic colloid layer of silver halide photographic light-sensitive elements can be used as such basic polymers, for example, dialkylamino group, aminoguanidino group, secondary diamino group, quaternary salts or bisacrylamide, secondary amino group, and pyridino group containing basic polymers. While not to be construed as limitative, it is most preferred in accordance with the present invention that the basic polymer utilized have a molecular weight of from about 10,000 to about 300,000, and typically on a commercial scale the molecular weight thereof will be about 100,000.

In more detail, it is possible to use polymers derived from ethylenically unsaturated compounds having dialkylaminoalkyl ester residues as described in British Patent 685,475, copolymers of such compounds as described in U.S. Pat. No. 2,839,401, maleic acid anhydride copolymers or derivatives thereof as described in British Pat. No. 906,083, polymers produced by reacting polyvinylalkyl ketones with aminoguanidine as described in British Pat. No. 850,281, polymers having a 2-methylimidazole nucleus in a side chain as described in U.S. Pat. No. 3,445,231, addition polymers of bisacrylamide and a secondary diamine or the quaternary salts thereof as described in Japanese Pat. application (Laid Open) 24733/1973, copolymers of three or four monomers including polyvinylpyridine or polyvinylquinoline as described in British Pat. Nos. 765,520, and 766,202, and polymers as described in German Pat. Applications (OLS) 1,914,361 and 1,914,362.

While not to be construed as limitative, it is most preferred that any hydrophilic colloid layer used in forming the light-sensitive elements of the present invention have a thickness of from about 0.5 to about 10 $\mu$.

The emulsion layers and other hydrophilic colloid layers of the light-sensitive elements can contain other known water soluble dyes in addition to the water soluble dyes of the present invention in an amount which does not materially harm the effect of the present invention. It is particularly advantageous to use two or more dyes in combination when desired spectral absorption characteristics are not obtained using one dye. Examples of dyes which can be used include merocyanine dyes as described in Japanese Pat. Applications (Laid Open) 85130/1973 and 5125/1974 and Japanese Pat. Application 51927/1974, etc. It is also possible for an alkali soluble pigment such as manganese dioxide or a bleachable pigment such as colloidal silver to be present together with the dye according to the present invention.

Various additives having various functions for enhancing the quality of the photographic light-sensitive materials such as a hardener, a coating aid, a plasticizer, a lubricating agent, a matting agent, an emulsion polymerized latex, an antistatic agent, an ultraviolet light absorbing agent, an antioxidant, and the like can be incorporated in the hydrophilic colloidal layer of the present invention, in addition to hydrophilic colloid, dye, pigment and mordanting agent. These additives are described below.

In the light-sensitive element of the present invention, photographic emulsion layers and other hydrophilic colloidal layers can be hardened by adding a conventional hardener, if desired. Organic hardeners such as dimethylol urea, those described in U.S. Pat. No. 1,870,354, British Pat. Nos. 676,828, 825,544 and 1,167,207, U.S. Pat. Nos. 3,380,829, 3,047,394, 3,325,287, 3,362,827, 2,080,019, 2,725,162, 2,725,295 and 2,579,801, Japanese Pat. Publications 7133/1959, 1872/1971 and 38713/1971, German Pat. Nos. 872,153 and 1,090,427, British Pat. 994,869, U.S. Pat. Nos. 3,255,000, 3,635,718, 2,992,109, 3,103,437 and 3,057,723, etc., inorganic hardeners such as chromium alum, chromium acetate, zirconium sulfate, etc., and the like can be used as the hardener.

The photographic emulsion layers and other hydrophilic colloidal layers in the light-sensitive element of the present invention can contain various known surface active agents as a coating aid, for antistatic purposes, for improvement of sliding properties and other purposes. For example, nonionic surface active agents such as saponin, polyethylene glycol, polyethylene glycol-polypropylene glycol condensates as described in U.S. Pat. No. 3,294,540, polyalkylene glycol ethers described in U.S. Pat. Nos. 2,240,472, and 2,831,766, polyalkylene glycol esters, polyalkylene glycol amides, and the like; anionic surface active agents such as alkylcarboxylic acid salts, alkylnaphthalenesulfonates, N-acylated N-alkyltaurines as described in U.S. Pat. No. 2,739,891, the compounds described in U.S. Pat. No. 3,415,649 and the like; and amphoteric surface active agents such as the compounds described in British Pat. No. 1,159,825, Japanese Patent Publication 378/1965, Japanese Pat. Application (Laid Open) 43924/1973, U.S. Pat. No. 3,726,683, etc., can be used.

The hydrophilic colloid layers in the light-sensitive element of the present invention can contain a lubricating agent such as the higher alcohol esters of higher fatty acids as described in U.S. Pat. Nos. 2,588,756 and 3,121,060; casein as described in U.S. Pat. No. 3,295,979, higher fatty acid calcium salts as described in British Pat. No. 1,263,722 or silicone compounds as described in British Pat. No. 1,313,384 and U.S. Pat. Nos. 3,042,522 and 3,489,567. A dispersion of liquid paraffin can also be used for this purpose.

The photographic emulsion layers and other hydrophilic colloid layers in the light-sensitive element of the present invention can contain a plasticizer such as glycerin, diols as described in U.S. Pat. No. 2,960,404, trihydric aliphatic alcohols as described in U.S. Pat. No. 3,520,694 or the like.

The photographic emulsion layers and other hydrophilic colloid layers in the light-sensitive element of the present invention can contain a dispersion of a water insoluble synthetic polymer or of a polymer slightly soluble in water for the purpose of improving dimensional stability and the like. For example, polymers containing as a monomer alkyl methacrylates, alkoxy methacrylates, glycidyl methacrylates, vinyl acetate, acrylonitrile, olefins or styrene, individually or in combination or containing these monomers and acrylic acid, acrylamides, $\alpha,\beta$-unsaturated dicarboxylic acids, sulfoalkyl acrylates, styrene-sulfonic acid or the like can be used. As specific examples, there are illustrated the polymers described in U.S. Pat. Nos. 2,376,055, 3,607,290, 3,645,740, British Pat. Nos. 1,186,699, 1,307,373, and U.S. Pat. Nos. 3,062,647, 2,739,137, 3,411,911, 3,488,708, 3,635,715 and 2,853,457.

The hydrophilic colloid layers in the light-sensitive element of the present invention can contain a matting agent such as inorganic particles, e.g., silica as described in Swiss Pat. No. 330,158, glass powder as described in French Patent 1,296,995, carbonates of alkaline earth metals, cadmium or zinc as described in British Pat. No. 1,173,181; and organic particles, e.g., starch as described in U.S. Pat. No. 2,322,037; starch derivatives as described in Belgian Pat. No. 625,451 or British Pat. No. 981,198; polyvinyl alcohol as described in Japanese Pat. Publication 3643/1969, polysytrene or polymethyl methacrylate as described in Swiss Pat. No. 330,158, polyacrylonitrile as described in U.S. Pat. No. 3,079,257 and polycarbonates as described in U.S. Pat. No. 3,022,169.

The photographic emulsion layers and other hydrophilic colloid layers in the light-sensitive element of the present invention can contain an ultraviolet absorbing agent such as compounds of the benzophenone series, the benzotriazole series, the thiazolidine series or the like. These ultraviolet absorbing agent can be mordanted to a specific layer in the same manner as with the dyes.

The photographic emulsion layers and other hydrophilic colloid layers in the light-sensitive element of the present invention can contain a brightening agent of the stilbene series, the triazine series, the oxazole series, the coumarin series or the like. Water soluble compounds can be used, and, in addition, water insoluble brightening agents can be used in the form of a dispersion.

The hydrophilic colloid layers in the light-sensitive element of the present invention can contain compounds used for the purpose of preventing color fog of color light-sensitive elements or preventing color mixing between layers, such as alkylhydroquinones, dialkylhydroquinones, aryl-substituted hydroquinones, sulfo-substituted hydroquinones, high molecular weight compounds containing hydroquinone residues, catechol derivatives, aminophenol derivatives, gallic acid derivatives, ascorbic acids or the like in the form of, if desired or necessary, a dispersion. Specific examples of these compounds are the compounds described in U.S. Pat. Nos. 2,336,327, 2,360,290, 2,403,721, 2,728,659, 2,732,300, 2,735,765, 2,675,314, 2,701,197, 2,816,028 and 2,704,713, British Pat. No. 1,133,500, Japanese Pat. Publication 13496/1968 and U.S. Pat. No. 3,457,079. In order to introduce these compounds into the hydrophilic colloid layer, a method of dispersion in a hydrophilic colloid together with a high boiling point organic solvent such as an aliphatic ester, an aromatic carboxylic acid alkyl ester, an aromatic phosphoric acid ester, an aromatic ether, or the like, a method of addition as an alkaline aqueous solution to a hydrophilic colloid, or a like method can be employed.

The silver halide photographic emulsion used for the light-sensitive element of the present invention can be prepared using various conventionally known techniques depending upon the end-use of the light-sensitive element so as to provide suitable characteristics.

Any of silver chloride, silver chlorobromide, silver bromide, silver iodobromide, silver iodochlorobromide and the like can be used as the silver halide, and the halogen content ratio is not particularly limited.

Known processes can be employed for preparing the silver halide emulsion. For example, the principles and processes described in C. E. K. Mees, The Theory of the Photographic Process, 3rd Ed., Macmillan Co., New York (1966); P. Glafkides, Chimie Photographique, 2nd Ed., Photocinema Paul Montel, Paris (1957); H. Frieser, Die Grundlagen der Photographische Prozesse mit Silverhalogeniden, Vol. 2, pp. 609 to 674 and 735 to 743, Akademische Verlaggesellschaft, Frankfurt-am-Main (1968); and the like can be used. Any of an acidic process, a neutral process and an ammoniacal process can be used, and a single jet or a double jet process (also called a twin jet process) can be used.

The silver halide emulsion can contain either coarse grains or fine grains. The mean value of the grain diameter or edge length (or a corresponding value showing the grain size) (numerical average measured according to a projection method) is preferably 0.04 to 4 microns. The grain size distribution (with the grain size being in the sense as described above) can be either narrow or broad.

The silver halide emulsion can be either physically ripened or not physically ripened. Usually, soluble salts are removed from the emulsion after the formation of precipitate or after physical ripening. As the means for salt removal, a noodle washing method, long well-known, or a flocculation method utilizing inorganic salts containing a multivalent anion (e.g., ammonium sulfate, etc.), anionic surface active agents, anionic polymers (e.g., polystyrenesulfonic acid, etc.) or gelatin derivatives (e.g., aliphatic or aromatic acylated gelatin, etc.) can be employed.

As the silver halide emulsion, an emulsion which has not been chemically sensitized (a non-after-ripened emulsion) can be used, although the emulsion can be chemically sensitized. Suitable processes for chemical sensitization include the processes described in Mees, supra, Glafkides, supra, or Frieser, supra, and other various known processes. That is, sulfur sensitization using compounds containing sulfur capable of reacting with silver ions such as a thiosulfate or the compounds as described in U.S. Pat. Nos. 1,574,944, 2,278,947, 2,410,689, 3,189,458 and 3,501,313, French Pat. No. 2,059,245 or using active gelatin; reduction sensitization using a reducing agent such as stannous chloride as described in U.S. Pat. No. 2,487,850, amines as described in U.S. Pat. No. 2,518,698, 2,521,925, 2,521,926, 2,419,973 and 2,419,975, iminoaminomethanesulfinic acid as described in U.S. Pat. No. 2,983,610 or silane compounds as described in U.S. Pat. No. 2,694,637; gold sensitization using a gold complex salt as described in U.S. Pat. No. 2,399,083 or a gold-thiosulfate complex salt; sensitization using salts of noble metals such as platinum, palladium, iridium, rhodium or ruthenium as described in U.S. Pat. Nos. 2,448,060, 2,540,086, 2,566,245 and 2,566,263, individually or in combination can be employed.

The photographic emulsions used for the light-sensitive elements of the present invention can be spectrally sensitized for long wavelength blue light, green light, red light or infrared light using sensitizing dyes. As sensitizing dyes, cyanine dyes, merocyanine dyes, complex cyanine dyes, complex merocyanine dyes, holopolar cyanine dyes, styryl dyes, hemicyanine dyes, oxonol dyes and hemioxonol dyes can be used. The cyanine dyes can have any nitrogen containing heterocyclic ring selected from pyrroline, oxazoline, thiazole, pyrrole, oxazole, thiazole, selenazole, imidazole, pyridine and tetrazole as a basic nucleus. These nuclei can have on the nitrogen atoms aliphatic groups such as alkyl groups, alkenyl groups, alkylene groups, hydroxyalkyl groups, carboxyalkyl groups, sulfoalkyl groups, aminoalkyl groups, alkoxyalkyl groups, sulfohydroxyalkyl groups, or sulfoalkoxyalkyl groups as substituents. Further, these nuclei can be condensed with an aromatic ring (such as a benzene ring, naphthalene ring, etc.), an alicyclic hydrocarbon ring (such as a cyclohexene ring, etc.) or a heterocyclic nucleus (such as a quinoxaline ring, quinoline ring, pyridine ring, etc.), which may be unsubstituted or substituted with halogen atoms, alkyl groups, alkoxy groups, hydroxy groups, cyano groups, carboxy groups, alkoxycarbonyl groups, alkylamino groups, dialkylamino groups, acylamino groups, acyl groups, phenyl groups or fluoroalkyl groups. The cyanine dyes can be symmetrical or unsymmetrical and the methine and polymethine chains of the dyes can be substituted with an alkyl group, a phenyl group, a substituted phenyl group such as a carboxyphenyl group, etc., or a heterocyclic nucleus such as a furyl group, a thienyl group, etc. Further, a part of the methine chains can combine together with other atom(s) to form a 5- or 6-membered ring. As the merocyanine dyes, those having an acid nucleus such as a 2-thiaoxazolidinedione nucleus, a rhodanine nucleus, a thiohydantoin nucleus, etc., together with the above described basic nucleus can be used. The above described acid nuclei can be substituted, at their nitrogen atoms or carbon atoms, with alkyl groups, alkylene groups, phenyl groups, hydroxyalkyl groups, carboxyalkyl groups, sulfoalkyl groups, alkoxyalkyl groups, aminoalkyl groups, acylamino groups, heterocyclic nuclei such as a furfuryl group, etc. These sensitizing dyes can be used individually or can be used as a combination thereof. A large number of combinations of sensitizing dyes for supersensitization are known and can be used.

The photographic emulsions in the light-sensitive element of the present invention can contain various additives for the purpose of preventing fog or stabilizing the photographic properties during their production, during storage of the light-sensitive element or during development processing. That is, azoles (e.g., benzotriazole, benzothiazolium salts as described in U.S. Pat. No. 2,131,038, aminobenzimidazole as described in U.S. Pat. No. 2,324,123, etc.); nitroazoles (e.g., nitroindazole, nitrobenzotriazole, nitrobenzimidazoles as described in British Pat. No. 403,789, nitroaminobenzimidazoles as described in U.S. Pat. No. 2,324,123, etc.), halogen-substituted azoles (e.g., 5-chlorobenzimidazole, 5-bromobenzimidazole, 6-chlorobenzimidazole, etc.); mercaptoazoles (e.g., mercaptothiazole derivatives as described in U.S. Pat. No. 2,824,001, mercaptobenzothiazole, the derivatives thereof as described in U.S. Pat. No. 2,697,009, mercaptoimidazole derivatives as described in U.S. Pat. No. 3,252,799, mercaptobenzimidazole, mercaptoxadiazole as described in U.S. Pat. No. 2,843,491, mercaptothiadiazole as described in U.S. Pat. No. 1,758,576, phenylmercaptotetrazole as described in U.S. Pat. No. 2,403,927, etc.), mercaptopyrimidine as described in U.S. Pat. No. 2,304,962; mercaptotriazine as described in U.S. Pat. No. 2,476,536; mercaptotetrazaindene as described in British Pat. No. 893,428, various mercapto compounds (e.g., thiosalicylic acid as described in U.S. Pat. No. 2,377,375, thiobenzoic acid as described in U.S. Pat. No. 3,226,231; sugar mercaptal as described in Japanese Pat. Publication 8743/1972, etc.); oxazolinethione as described in U.S. Pat. No. 3,251,691; triazolothiadiazole as described in Japanese Patent Publication 17932/1968; and the like can be added.

Also, nitrogen-containing heterocyclic compounds having an anti-fogging action such as azaindene compounds (e.g., tetrazaindenes, such as the compounds described in U.S. Pat. Nos. 2,444,605, 2,444,606 and 2,450,397, Japanese Pat. Publications 10166/1964 and 10516/1967, pentazaindenes such as the compounds as described in U.S. Pat. No. 2,713,541, Japanese Pat. Publication 13495/1968), urazole compounds as described in U.S. Pat. 2,708,161, etc., can be employed.

Also, benzenesulfinic acid as described in U.S. Pat. No. 2,394,198, benzenethiosulfonic acid, benzenesulfinic acid amide as described in Japanese Pat. Publication 4136/1968, and the like can be added.

Further, various chelating agents as described in U.S. Pat. No. 2,691,588, British Pat. No. 623,488 and Japanese Pat. Publications 4941/1968 and 13496/1968 can be added for preventing fog due to metal ions.

The photographic emulsion layers in the light-sensitive element of the present invention can contain a conventionally used, non-diffusible, dye image-forming coupler. A dye image-forming coupler (hereinafter abbreviated "color coupler") is a compound capable of forming a dye by reaction, upon photographic development, with an oxidation product of an aromatic primary amine developing agent. The color couplers can be either a 4-equivalent type or a 2-equivalent type or, also, they can be colored couplers for color correction or couplers capable of releasing a development inhibitor. As yellow-forming couplers, there can be usefully used open chain ketomethylene compounds such as acylaminoacetamide compounds, as magenta-forming couplers, pyrazolone compounds or cyanoacetyl compounds, and as cyan-forming couplers, naphtholic or phenolic compounds. Couplers can be introduced into the photographic emulsion layers using methods commonly employed for multi-color light-sensitive materials.

As will be appreciated by one skilled in the art, the coupler(s) is typically incorporated in an emulsion layer so that one mol of coupler is present for every 2 to 50 mols of silver halide.

The present invention can also be applied to a multilayer, multi-color photographic material comprising a support having thereon at least two light-sensitive layers having different spectral sensitivity. Multi-layer color photographic materials usually comprise a support having thereon at least one red-sensitive silver halide emulsion layer, one green-sensitive silver halide emulsion layer and one blue-sensitive silver halide emulsion layer. The sequence of these layers can be optionally selected as required. Usually, the red-sensitive silver halide emulsion layer is combined with a cyan-forming coupler, the green-sensitive silver halide emulsion layer with a magenta-forming coupler, and a blue-sensitive silver halide emulsion layer with a yellow-forming coupler, although different combinations can be used in certain cases.

As a support, there can be used either transparent or opaque supports as are usually used for photographic elements such as glass plates comprising soda glass, quartz glass, or a like glass; films comprising synthetic polymers of polyalkyl methacrylates, polystyrene, polyvinyl chloride, partially formylated polyvinyl alcohol, polycarbonate, polyesters (e.g., polyethylene terephthalate, etc.) or polyamides; films comprising cellulose derivatives (e.g., cellulose nitrate, cellulose acetate, cellulose acetate butyrate, etc.); paper; baryta coated paper; α-olefin polymer coated paper; synthetic papers comprising polystyrene or the like; ceramics; metal; and the like.

The photographic emulsion layers and other layers of the light-sensitive element of the present invention can be coated according to various known coating methods. Suitable coating methods include dip coating, air knife coating, roller coating, curtain coating and extrusion coating. The method described in U.S. Pat. No. 2,681,294 is an advantageous method. Also, two or more layers can be coated at the same time using the method described in, e.g., U.S. Pat. Nos. 2,761,791 and 3,526,528.

The light-sensitive element of the present invention can contain an antistatic layer or an electrically conductive layer, e.g., a metal layer formed by vacuum evaporation or electrodeposition or an ionic polymer layer.

All known processes can be used for the photographic processing of the light-sensitive element of the present invention. Known solutions can be used as the processing solution with the processing temperatures being less than about 18° C, about 18° to about 50° C and higher than about 50° C.

To the light-sensitive element of the present invention can be applied any processing procedures for forming silver images (black and white photographic processing) and for forming dye images (color photographic processing), depending on the purpose.

In the case of subjecting the light-sensitive element of the present invention to a black and white photographic processing, the developer solution used can contain a known developing agent in a conventional amount. As the developing agent, there can be used, individually or in combination, dihydroxybenzenes (e.g., hydroquinone, chlorohydroquinone, bromohydroquinone, 2,3-dichlorohydroquinone, methylhydroquinone, catechol, etc.), 3-pyrazolidones (e.g., 1-phenyl-3-pyrazolidone, 1-phenyl-4-methyl-3-pyrazolidone, 1-phenyl-5-methyl-3-pyrazolidone, etc.), aminophenols (e.g., o-aminophenol, p-aminophenol, N-methyl-o-aminophenol, N-methyl-p-aminophenol, 2,4-diaminophenol, etc.), pyrogallol, ascorbic acid, 1-aryl-3-pyrazolines (e.g., 1-(p-hydroxyphenyl)-3-aminopyrazoline, 1-(p-methylaminophenyl)-3-aminopyrazoline, 1-(p-aminophenyl)-3-aminopyrazoline, etc.), and the like.

To the developer solution can be generally added a preservative (e.g., sulfites, bisulfites, ascorbic acid, etc.), an alkali agent (e.g., hydroxide, carbonates, etc.), a pH buffer (e.g., carbonates, borates, boric acid, acetic acid, citric acid, alkanolamines, etc.).

Further, the developer solution can contain, if desired, a dissolving aid (e.g., polyethylene glycols, esters thereof, alkanolamines, etc.), a sensitizing agent (e.g., nonionic surface active agents containing a polyoxyethylene chain, quaternary ammonium compounds, etc.), a surface active agent, an anti-fogging agent (e.g., halides such as potassium bromide and sodium bromide, nitrobenzindazole, nitrobenzimidazole, benzotriazole, benzothiazole, tetrazoles, etc.), a chelating agent (e.g., ethylenediaminetetraacetic acid or the alkali metal salts thereof, nitrilotriacetate, polyphosphates, etc.), a development accelerator (e.g., the compounds described in U.S. Pat. No. 2,304,025 and Japanese Pat. Publication 45541/1972, etc.), a hardener (e.g., glutaraldehyde, etc.), or an antifoaming agent and the like.

A "lith-type" development processing can be applied to the light-sensitive element of the present invention. "Lith-type" development processing means a development processing in which the development is conducted in an infectious manner under a low sulfite ion concentration using (usually) dihydroxybenzenes as a developing agent, for the photographic reproduction of line images or the photographic reproduction of half tone images through half tone dots. The details of such are described in Mason, Photographic Processing Chemistry, pp. 163 - 165 (1966).

As the fixing solution, a fixing solution of a generally used composition can be used.

The dye images are formed in a conventional manner. For example, the negative-positive process as described in the Journal of the Society of Motion Picture and Television Engineers, Vol. 61, pp. 667 - 701 (1953); a color reversal process comprising image-wise exposure, forming a negative silver image by developing with a developer solution containing a black-and-white developing agent, a uniform exposure (or other suitable fogging processing) at least once, and subsequently conducting color development to form a positive dye image; a process using a direct positive emulsion to obtain a positive dye image and the like can be employed.

A color developer solution generally comprises an alkaline aqueous solution containing a color developing agent. Examples of color developing agents include known primary aromatic amine developing agents, for example, phenylenediamines (e.g., N,N-diethyl-p-phenylenediamine, N-ethyl-N-(β-hydroxyethyl)amino-2-methylaniline, 4-(N-ethyl-N-β-methanesulfonamidoethyl)amino-2-methylaniline, N,N-diethylamino-2-ethoxyaniline, etc.), p-aminophenols (e.g., 4-aminophenol, 2,6-dichloro-4-aminophenol, 2-bromo-4-aminophenol, etc.), and the like. They are used in a conventional amount. The color developer solution can further contain common additives such as alkali metal sulfites, carbonates, bisulfites, bromides, iodides, alkaline buffers, etc. Further, if desired, a dye-forming coupler, a competitive coupler, an anti-fogging agent, a hardener, an antioxidant, a thickening agent, and the like can be added.

According to the present invention, the light-sensitive elements have a sufficient absorption density where a filter layer, an antihalation layer or a dyed hydrophilic colloid layer is provided, even though the thickness of such layer is very thin so as to maintain high resolving power. This is because the dye used in the present invention has high water solubility and good compatibility with gelatin. In the light-sensitive elements of the present invention, the dyed layer is easily and irreversibly decolored in photographic processing and does not give rise to residual color in the light-sensitive element after processing. Also, the processing solutions are not contaminated by coloration.

In the light-sensitive elements of the present invention, the photographic properties of the photographic emulsion layer are not adversely affected because of the dye present in the hydrophilic colloid layer. Namely, the sensitivity or gradation of the photographic emulsion layer is not subjected to desensitization or a reduction in contrast except for the filter effect of the dyed layer itself (where the dyed layer is positioned nearer the incident light of exposure than the emulsion layer), and, further, the photographic emulsion layer is not fogged. This effect appears on both photographic properties in the intrinsic sensitization wavelength range of silver halide and properties in the color sensitization range. Further, these adverse influences do not appear with the passage of time after preparation of the light-sensitive element.

In the light-sensitive elements of the present invention, only a basic polymer containing layer is dyed and the dye does not diffuse into other layers. Accordingly, no undesired deterioration of sensitivity or gradation of the photographic emulsion layer occurs from an undesired spectral absorption effect due to diffusion of the dye, and, consequently, light-sensitive elements having good photographic properties, particularly spectral properties, can be obtained. This is very advantageous in the case of black-and-white and color photographic light-sensitive elements having an antihalation layer between a photographic emulsion layer and a support or color photographic sensitive elements having at least three photographic emulsion layers and a filter layer which may also function as an antihalation layer and is positioned between these emulsion layers.

Namely, if the dye diffuses from the layer to be dyed into an upper emulsion layer (farther from the support) or into a farther upper hydrophilic colloid layer, the emulsion layer is affected by the filter effect of such dye, resulting in a deterioration of sensitivity to light in the wavelength range absorbed by the dye and a softening of gradation thereof (i.e., a flattening of the characteristic curve).

On the contrary, in the light-sensitive elements of the present invention, where such diffusion of the dye does not occur, deterioration of the sensitivity of the emulsion layers positioned above (farther from the support) the dyed layer can be substantially disregarded, and the logarithmic exposure does not exceed 0.06.

Embodiments and effects of the present invention will be further illustrated in greater detail with reference to the following Examples, where all percentages are weight percentages unless otherwise indicated.

EXAMPLE 1

A solution containing gelatin and having the following composition(s) was prepared.

| | |
|---|---|
| Gelatin | 40 g |
| Water | 600 cc |
| Poly(diethylaminoethyl methacrylate) (molecular weight: about 100,000) (5% aqueous solution) | 60 cc |
| Dye (as described below) (1% aqueous solution) | 100 cc |
| Hardening agent* (4% aqueous solution) | 200 cc |
| Phenoxy-polyoxyethylene-butane sulfonic acid (1% aqueous solution) | 40 cc |

*2,4-Dichloro-6-hydroxy-1,3,5-triazine sodium salt

Dyes 1, 2, 4, 6, 7, 9, 17 and 18 described hereinbefore and Comparison Dyes A, B, C and D having the following structural formula were used as the dye in the above formulation.

A.

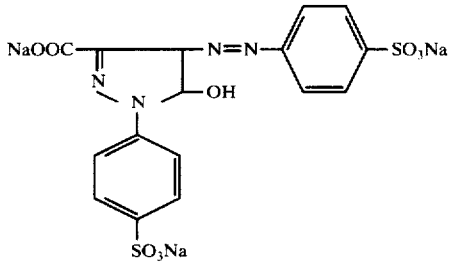

-continued

B.

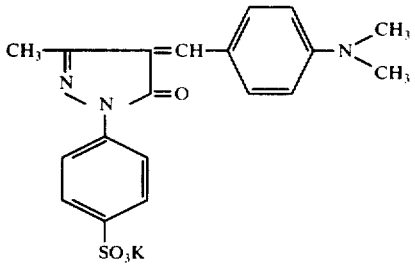

C.

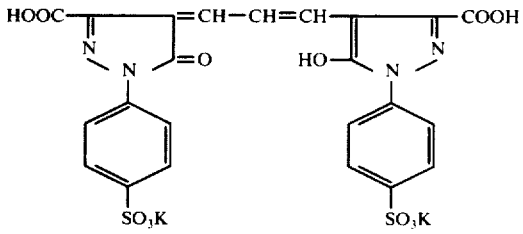

D.

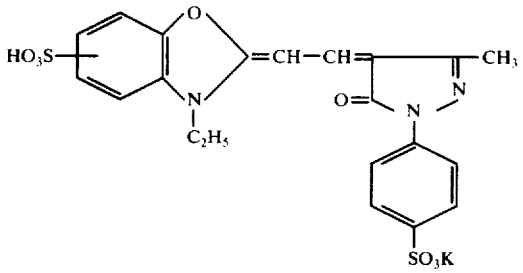

Each of the resulting solutions was applied to a cellulose acetate film to a dry thickness of 4 microns and dried. The spectral absorptions of each of the samples were then determined.

Further, a solution having the following composition was applied to a dry thickness of 8 microns to the resulting layer of each sample. It was then dried for about 20 minutes to conclude the drying.

| | |
|---|---|
| Gelatin | 40 g |
| Water | 980 cc |
| Sodium dodecylbenzene sulfonate (1% aqueous solution) | 50 cc |

After removing the second layer which was applied without adding the dye from each sample by dipping in warm water at 50° C for 5 minutes, while agitating, each sample was dried for 10 minutes. The spectral absorptions of each of these samples were again determined.

The optical density at the maximum absorption wavelength determined after application of the first layer is represented by $a_1$ and that determined after application and removal of the second layer is represented by $a_2$. The dye fixing ratio of the first layer is represented by $P = (a_2 a_1) \times 100$. The resulting values P for each sample are shown in the following Table 1.

Table 1

| Dye | P |
|---|---|
| 1 | 93 |
| 2 | 90 |
| 4 | 87 |
| 6 | 92 |
| 7 | 94 |
| 9 | 90 |
| 17 | 85 |

Table 1-continued

| Dye | | P |
|---|---|---|
| 18 | | 89 |
| A | (for comparison) | 60 |
| B | (for comparison) | 25 |
| C | (for comparison) | 55 |
| D | (for comparison) | 63 |

In the comparison samples using known Comparison Dyes A to D, the ratio of the residual dye in the first layer was low because the dyes diffused into the second layer and were removed together with the second layer. On the contrary, in the samples of the present invention, the greater part of the dyes (above 80%) remained in the first layer without diffusing into the second layer.

EXAMPLE 2

Samples prepared by applying only the first layer containing the dye as described in Example 1 were processed at 20° C for 2 minutes using a solution having the following composition, and they were then washed with water for 10 seconds and dried.

| | |
|---|---|
| N-Methyl-p-aminophenol sulfate | 2 g |
| Sodium sulfite | 100 g |
| Hydroquinone | 5 g |
| Borax | 2 g |
| Water to make | 1,000 cc |

In the comparison sample using Dye A, yellow coloration remained up to about a half of the initial density. The other samples were colorless and transparent.

EXAMPLE 3

To a cellulose acetate film having thereon a subbing layer, a silver iodobromide emulsion sensitized to red light containing a cyan color forming coupler was applied to a dry thickness of 5 μm. To this coated layer, a gelatin intermediate layer was applied to a dry thickness of 1.5 μm and then a silver iodobromide emulsion layer sensitized to green light containing a magenta color forming coupler was applied to a dry thickness of 4 μm. This film was divided into five equal parts. To these films, coating solutions having the following five compositions were applied, respectively, to form a yellow filter layer having a dry thickness of 2 μm. (The absorption density of the yellow filter layer at the absorption maximum wavelength was 0.9.) Further, a blue-sensitive silver iodobromide emulsion containing a yellow color forming coupler was applied thereto to a dry thickness of 5 μm. Then, a surface protective layer composed of gelatin was applied to a dry thickness of 1 μm. Thus, color negative light-sensitive materials Samples 3A to 3E were produced. The coating solution for the yellow filter layer in each sample had the following composition.

| | |
|---|---|
| 3A: | |
| Gelatin (8% aqueous solution) | 500 cc |
| Poly(diethylaminoethyl methacrylate) (molecular weight: about 100,000) (5% aqueous solution) | 60 cc |
| Dye A in Example 1 (1% aqueous solution) | 120 cc |
| Na salt of 2,4-dichloro-6-hydroxy-1,3,5-triazine (1% aqueous solution) | 25 cc |
| Dodecaethylene glycol-4-nonylphenol ether (2% aqueous solution) | 30 cc |

3B:

Dye D of Example 1 was used instead of the Dye A in 3A above. The amount of the solution (1% aqueous solution) added was 100 cc.

3C:

Dye 2 hereinbefore described was used instead of Dye A in 3A above. The amount of the solution (1% aqueous solution) added was 50 cc.

3D:

Dye 1 hereinbefore described was used instead of Dye A in 3A. The amount of the solution (1% aqueous solution) added was 50 cc.

| | |
|---|---|
| 3E- | |
| Gelatin (6% aqueous solution containing 8 g of Carey-Lea type yellow colloidal silver) | 500 g |
| Na salt of 2,4-dichloro-6-hydroxy-1,3,5-triazine (1% aqueous solution) | 25 cc |
| Polyethylene glycol-4-nonyl-phenol ether (2% aqueous solution; molecular weight: 660) | 30 cc |

Each sample was exposed to light for 1/200 second through a Fuji color separation filter SP-1 and a continuous gray wedge using a tungsten light source of a color temperature of 5,500° K and then each sample was processed as follows.

| Processing Step | Temperature (° C) | Time (minutes) |
|---|---|---|
| 1. Color development | 37.8 | 3½ |
| 2. Water wash | " | 1 |
| 3. Bleaching | " | 4½ |
| 4. Water wash | " | 1 |
| 5. Fixing | " | 6 |
| 6. Water wash | " | 1 |
| 7. Stabilization | " | 1 |

The processing solutions used had the following composition.

| | | |
|---|---|---|
| Color Developer Solution | | |
| Sodium hydroxide | 2 | g |
| Sodium sulfite | 2 | g |
| Potassium bromide | 0.4 | g |
| Sodium chloride | 1 | g |
| Borax | 4 | g |
| Hydroxylamine | 2 | g |
| Tetra-sodium ethylenediamine tetraacetate | 2 | g |
| 4-Amino-3-methyl-N-ethyl-N-(β-hydroxyethyl)-aniline sesquisulfate (monohydrate) | 4 | g |
| Water to make | 1 | l |
| Bleaching Solution | | |
| Sodium salt of ethylenediamine tetraacetate-ferric complex salt | 100 | g |
| Potassium Bromide | 50 | g |
| Ammonium nitrate | 50 | g |
| Boric acid | 5 | g |
| Water to make | 1 | l |
| Fixing Solution | | |
| Sodium thiosulfate | 150 | g |
| Sodium sulfite | 15 | g |
| Borax | 12 | g |
| Glacial acetic acid | 15 | ml |
| Potassium alum | 20 | g |
| Water to make | 1 | l |
| Stabilizing Solution | | |
| Boric acid | 5 | g |
| Sodium citrate | 5 | g |
| Sodium metaborate (tetrahydrate) | 3 | g |
| Potassium alum | 15 | g |
| Water to make | 1 | l |

The photographic characteristic curve of the yellow image of each processed sample was determined and exposure necessary to obtain a density of fog + 0.1 was determined from the characteristic curve. The sensitivity is shown as a reciprocal of the exposure amount. The resulting relative values of sensitivity and the degree of stain of each sample obtained were as follows.

| Sample No. | Relative Sensitivity of Yellow Image by Blue Light Exposure | Stain |
|---|---|---|
| 3A | 71 | None |
| 3B | 85 | None |
| 3C | 97 | None |
| 3D | 96 | None |
| 3E | 100 | Present |

In Samples 3A and 3B wherein Comparison Dyes A and D was used, respectively, the sensitivity of the blue sensitive emulsion layer was quite inferior to that of control Sample 3E because of a filter effect due to diffusion of the dye from the yellow filter layer into the blue sensitive emulsion layer. In Samples 3C and 3D according to the present invention, the sensitivity was substantially the same as that of the control Sample 3E wherein colloidal silver was used in the yellow filter layer, and, further, no stain was observed.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive element comprising a support having thereon at least one silver halide emulsion layer, said photographic light-sensitive element containing at least one dye represented by general formula (I) in at least one hydrophilic colloid layer:

(I)

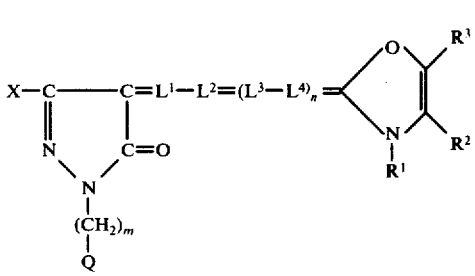

wherein X represents an amino group, a hydroxy group or an alkoxy group; $m$ represents 0 or 1; Q represents an aryl group substituted with at least one of the groups selected from a sulfo group, a sulfoalkyl group or a carboxy group; $R^1$ represents an aliphatic group; $R^2$ and $R^3$, which may be the same or different, each represents a halogen atom, an alkyl group, an alkoxycarbonyl group, an acyl group or a carboxy group; $L^1$, $L^2$, $L^3$ and $L^4$ each represents a methine group, an alkyl substituted methine group or a phenyl substituted methine group; and $n$ represents 0 or 1, wherein said at least one hydrophilic colloid layer and said at least one silver halide emulsion layer are on the same side of said support.

2. The silver halide photographic light-sensitive element as claimed in claim 1, wherein said amino group for X is a monoalkyl substituted amino group having 1 to 6 carbon atoms, a dialkyl substituted amino group having 2 to 8 carbon atoms, an amino group substituted with an acyl group containing an aliphatic hydrocarbon group having 1 to 8 carbon atoms or an aromatic hydrocarbon group, an aryl substituted amino group having 6 to 8 carbon atoms or a cyclic amino group.

3. The silver halide photographic light-sensitive element as claimed in claim 1, wherein said amino group for X is an unsubstituted ureido group or a ureido group substituted with an alkyl group having 1 to 8 carbon atoms, a substituted alkyl group having 1 to 8 carbon atoms in the alkyl moiety, an alicyclic hydrocarbon group having 5 to 6 carbon atoms, a monocyclic aryl group, an aralkyl group having 7 to 10 carbon atoms, an alkylcarbonyl group having 2 to 8 carbon atoms, in aromatic carboxylic type acyl group, an alkylsulfonyl group having 1 to 6 carbon atoms, an arylsulfonyl group or a heterocyclic group.

4. The silver halide photographic light-sensitive element as claimed in claim 1, wherein said alkoxy group for X is an alkoxy group having 1 to 8 carbon atoms or an alkoxy group having 1 to 8 carbon atoms substituted with a halogen atom or an alkoxy group.

5. The silver halide photographic light-sensitive element as claimed in claim 1, wherein said aryl group for Q is a monocyclic or dicyclic aryl group.

6. The silver halide photographic light-sensitive element as claimed in claim 1, wherein said aliphatic group for $R^1$ is an alkyl group having 1 to 8 carbon atoms or an alkyl group having 1 to 8 carbon atoms substituted with a halogen atom, a cyano group, an aryl group, a carboxy group, a sulfoalkoxy group or a sulfo group.

7. The silver halide photographic light-sensitive element as claimed in claim 1, wherein said acyl group for $R^2$ or $R^3$ is an acetyl group, chloroacetyl group or cyanoacetyl group.

8. The silver halide photographic light-sensitive element as claimed in claim 1, wherein said alkoxycarbonyl group for $R^2$ or $R^3$ is an alkoxycarbonyl group having 2 to 7 carbon atoms.

9. The silver halide photographic light-sensitive element as claimed in claim 1, wherein said alkyl group for $R^2$ or $R^3$ is an alkyl group having 1 to 6 carbon atoms.

10. The silver halide photographic light-sensitive element as claimed in claim 1, wherein said alkyl substituted methine group is a methine group substituted with an alkyl group having 1 to 4 carbon atoms.

11. The silver halide photographic light-sensitive element as claimed in claim 1, wherein X represents an alkoxy group, a hydroxy group, a substituted amino group or a substituted ureido group; $m$ is 0; Q represents a phenyl group substituted with at least one sulfo group; $R^1$ represents an alkyl group, a carboxyalkyl group or a sulfoalkyl group; $R^2$ and $R^3$ each represents a hydrogen atom or an alkyl group; $L^1$, $L^2$, $L^3$ and $L^4$ each represents an unsubstituted methine group or $L^1$ further represents a methyl substituted methine group; and $n$ is 0 or 1.

12. The silver halide photographic light-sensitive element as claimed in claim 1, which contains from 8 to 800 mg/m$^2$ of the dye per $m^2$ of the light-sensitive element.

13. The silver halide photographic light-sensitive element as claimed in claim 1, wherein said at least one hydrophilic colloid layer further contains a basic polymer which is present in an amount such that about 2 to about 15 basic functional groups in the baisc polymer are present per mol of said dye.

14. The silver halide photographic light-sensitive element as claimed in claim 1, wherein said at least one hydrophilic colloid layer is positioned above said at least one silver halide emulsion layer on said support.

15. The silver halide photographic light-sensitive element as claimed in claim 1, wherein said at least one hydrophilic colloid layer is positioned between said at least one silver halide emulsion layer and another silver halide emulsion layer on said support.

16. The silver halide photographic light-sensitive element as claimed in claim 1, wherein said at least one hydrophilic colloid layer is positioned between said at least one silver halide emulsion layer and said support.

* * * * *